US005422219A

United States Patent [19]

Anzai et al.

[11] Patent Number: 5,422,219

[45] Date of Patent: Jun. 6, 1995

[54] METHOD AND APPARATUS FOR FORMING TONER IMAGE

[75] Inventors: Masayasu Anzai; Yosuke Saito; Shinichi Nishino, all of Ibaraki, Japan

[73] Assignee: Hitachi Koki Co., Ltd., Tokyo, Japan

[21] Appl. No.: 60,793

[22] Filed: May 13, 1993

Related U.S. Application Data

[63] Continuation of Ser. No. 715,281, Jun. 14, 1991, abandoned.

[30] Foreign Application Priority Data

Jun. 15, 1990 [JP] Japan ..... 2-158129

[51] Int. Cl.[6] ..... G03G 9/08

[52] U.S. Cl. ..... 430/122; 430/45; 430/106.6

[58] Field of Search ..... 430/122, 45, 106.6

[56] References Cited

U.S. PATENT DOCUMENTS

| | | | |
|---|---|---|---|
| 4,862,828 | 9/1989 | Kumasaka et al. | 430/122 |
| 5,009,973 | 4/1991 | Yoshida et al. | 430/122 |
| 5,064,739 | 11/1991 | Asanae et al. | 430/122 |
| 5,239,343 | 8/1993 | Sakemi et al. | 355/253 |

*Primary Examiner*—Mark A. Chapman
*Attorney, Agent, or Firm*—Sughrue, Mion, Zinn, Macpeak & Seas

[57] ABSTRACT

In an image forming method wherein a toner image formed on a photoreceptor by the sequence of a charging step, an imagewise exposure step and a development step is transferred and fixed on a recording sheet by a transfer and a fixing step, the improvement wherein the developer used in the development step comprises at least 30 wt % of a toner having a particle size of no more than 8 μm and a magnetic carrier of low saturation magnetization, the toner being capable of carrying electric charges in a quantity greater than the value at which a maximum amount of the toner is deposited for development, the toner being electrified to have a charge quantity greater than a predetermined level by mixing the toner and the carrier under agitation before the effective development region is reached, a magnetic brush being formed after the toner electrification, the carrier and the toner being then given a localized movement and vibrational force in the effective development region, the toner being deposited on the latent electrostatic image under the action of an electrical or mechanical disturbance that promotes the supply and separation of the toner particles, whereby a toner image is formed on the photoreceptor, the toner image being then transferred onto the recording sheet by a transfer device holding a constant electric field and, following this transfer step, the residual toner on the photoreceptor being charged again and subsequently removed from the photoreceptor under the action of an electric field.

10 Claims, 6 Drawing Sheets

METHOD AND APPARATUS FOR FORMING TONER IMAGE

This is a Continuation of application Ser. No. 07/715,281, filed Jun. 14, 1991, now abandoned.

BACKGROUND OF THE INVENTION

This invention relates to a method and apparatus for forming a toner image by developing a latent electrostatic image with a dry developing agent in electrophotography and electrostatic recording.

In electrophotography and electrostatic recording, a latent electric image comprising a charge pattern or a conductivity pattern is formed on or in a photoconductive photoreceptor or a dielectric insulator (which are hereinafter collectively referred to as "a recording medium") and subsequently rendered visible by development through deposition of pigmented particles (toner). To implement these image forming methods, many techniques and apparatus have been proposed. Japanese Patent Publication Nos. 55708/1988 and 47392/1980 disclose a laser printer that combines electrophotographic technology with laser beam scanning technology and its use is gaining in popularity because of the ability to print out computer information. However, the demand for recording images of finer and higher-quality with higher process reliability using a smaller apparatus is ever increasing today and cannot be fully met by the conventional methods and apparatus for forming a toner image. From the viewpoints of ease of handling and of image quality, a latent electric image is conventionally rendered visible by methods of development that use a dry toner powder (see Japanese Patent Publication Nos. 30946/1985, 10869/1979 and 25356/1988) but considerable difficulty has been encountered in producing finer images of higher quality with the conventional dry developers agents and the image forming apparatus that use them.

SUMMARY OF THE INVENTION

The present invention has been achieved under these circumstances and has as an object providing a method by which a latent electrostatic image can be developed to form a finer and higher-quality toner image with higher process reliability.

Another object of the present invention is to provide an apparatus that is suitable for implementing that method of development.

The first object of the present invention can be attained by an image forming method that uses a toner comprising at least 30 wt % of fine particles not larger than 8 μm to form in a consistent manner a fine image that has a recording density of about 16–32 lines per millimeter.

The second object of the present invention can be attained by a highly reliable image forming apparatus that insures a fine image of high quality to be produced over an extended period by an image forming process in which a developing unit capable of supplying a toner in an increased amount by promoting the reseparation and movement of toner particles in the effective region of development is combined with a method of applying a development voltage in such a way as to prevent a magnetic carrier in the developer from being deposited on the recording medium, a field transfer method that effectively inhibits not only the variation in the efficiency of transfer onto the recording sheet but also the decrease in image resolution, a field cleaning method that is capable of efficient removal of residual toner particles from the recording medium, and a fixing method that causes minimum image blurring.

The image forming method of the present invention is applicable not only to electrophotography but also to other methods of rendering latent electric images visible, as well as to printers and copiers.

DETAILED DESCRIPTION OF THE INVENTION

Figure 1:
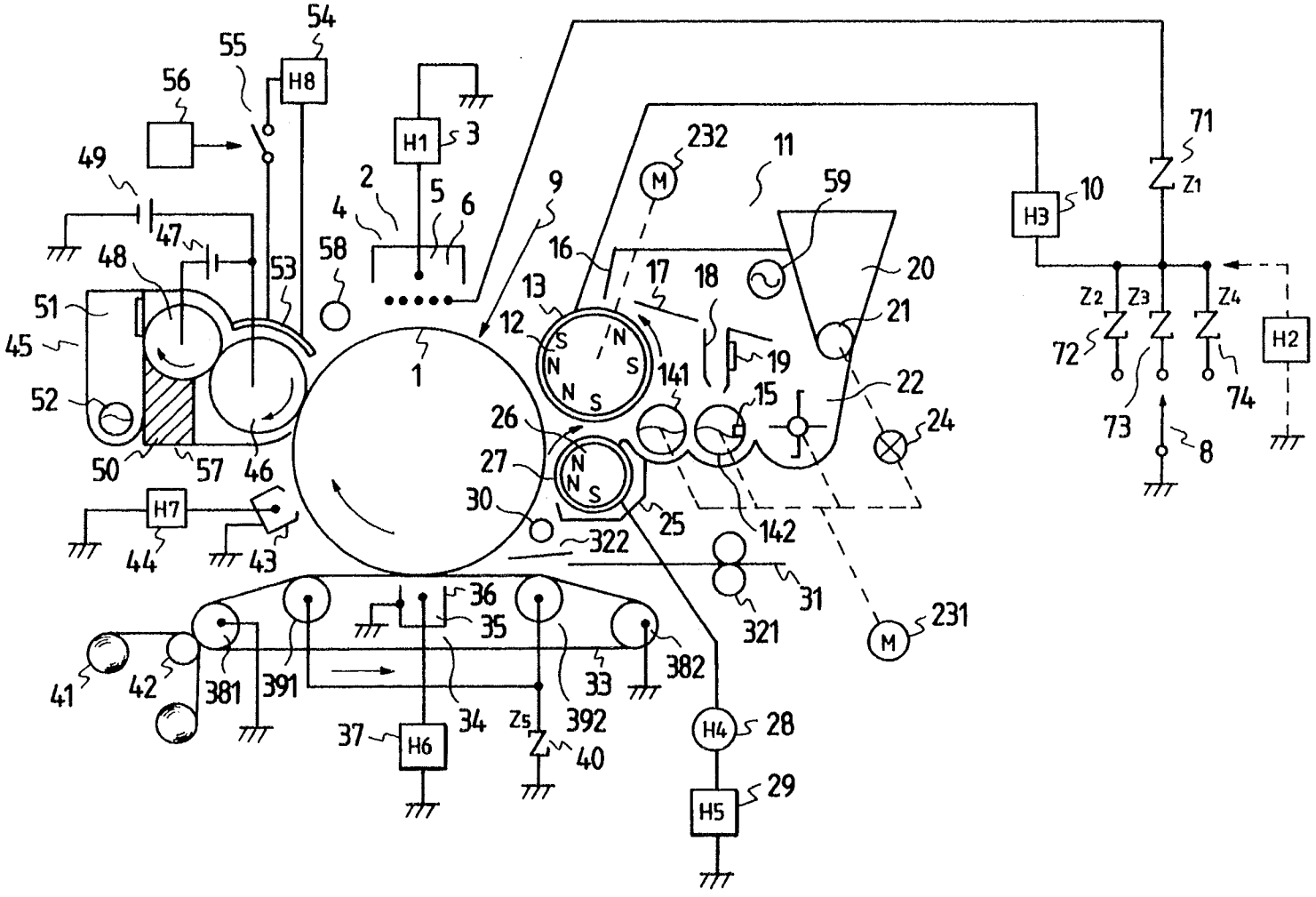
FIG. 1 is a schematic diagram for an electrophotographic printer to which the image forming method of the present invention is applied.

FIG. 1 is a schematic diagram for an electrophotographic printer to which the image forming method of the present invention is applied. The surface of a photoreceptor drum 1 comprising a photoconductive photoreceptor formed on a drum of conductive substrate is uniformly electrified with a charging device 2. The charging device 2 has a corona wire 5 suspended in the center of a conductive shield casing 4, with a screen grid 6 being provided at the open end. When a high voltage is applied from a dc high-voltage power source $H_1$ 3 to the corona wire 5, corona ions are generated and applied onto the surface of the photoreceptor drum 1 for its electrification. Subsequently, an optical image beam 9 is applied to the charge surface of the photoreceptor drum 1 to form a latent electrostatic image that corresponds to computer information output or some other original information. The resulting latent electrostatic image is developed by toner deposition in a developing unit 11. A development roll 13 in the developing unit 11 and the screen grid 6 in the charge device 2 are respectively supplied with a development bias voltage and a charge control bias voltage. Part of the corona discharge current generated from the charge device 2 flows through a constant-voltage element $Z_1$ 71 connected to the screen grid 6 and through either one of constant-voltage elements $Z_2$ 72, $Z_3$ 73 and $Z_4$ 74 which are connected to $Z_1$ 71. The constant-voltage elements $Z_2$ 72, $Z_3$ 73 and $Z_4$ 74 are selectively operated by changing the contact position of an image density select switch 8. The voltage to be applied as a development bias is extracted from the junction between constant-voltage element $Z_1$ and each of constant-voltage elements $Z_2$, $Z_3$ and $Z_4$. An auxiliary alternating power source 10 for supplying development bias is connected in series between these terminals for development bias voltage and the development roll 13. The application of an alternating voltage is effective for various purposes including improvement in the efficiency of development, the inhibition of selective development, reseparation of agglomerating fine toner particles and inhibition of carrier deposition on the photoreceptor and, as a result, images of high resolution can be obtained. An alternating voltage may also be applied to screws 141 and 142, as well as to a toner mixer 22 and this is effective in promoting the reseparation of agglomerated toner particles. A voltage of 50–1,000 V can be obtained from constant-voltage elements $Z_2$'$Z_4$, whereas the alternating power source 10 produces a voltage of 0–1,000 V at a frequency of 200 Hz–10 kHz (preferably 500–13,000 Hz). Instead of obtaining a development bias voltage from constant-voltage elements $Z_2$–$Z_4$, an external dc power source $H_2$ capable of voltage adjustment may be provided as indicated by a dashed line at the right end of FIG. 1. With this arrangement, the dc bias voltage to be applied to the development roll may be varied for changing the image density and yet the difference between the dc bias voltage applied to the development roll and the voltage at the surface of the photoreceptor drum 1 can be maintained at a constant level that is determined by the constant-voltage element $Z_1$. The constant-voltage element $Z_1$ may be such that it produces a voltage of 50–500 V. By establishing a generally constant relationship in this way between the surface voltage of the photoreceptor and the development bias voltage, it is possible to prevent a carrier of low saturation magnetization from being deposited on the surface of the photoreceptor when the development bias voltage is altered. To control the development bias voltage in a more desirable way, the residual voltage on the photoreceptor after exposure may also be detected to maintain the difference from the development bias voltage at a level that achieves the necessary image density.

Figure 2:
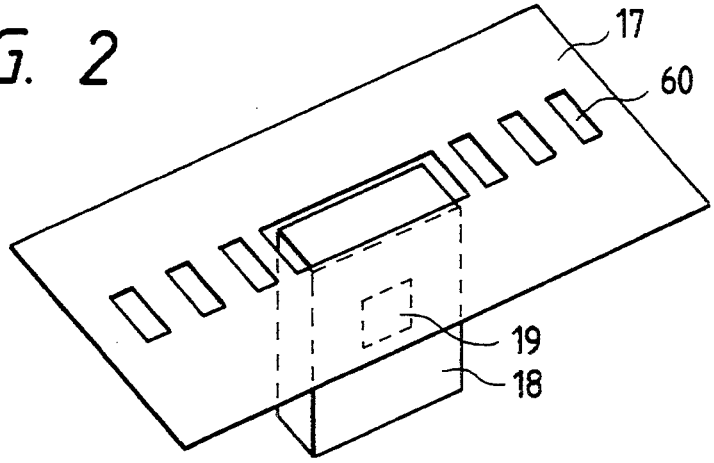
FIG. 2 is a perspective view showing a section used in the present invention for detecting the concentration of toner in a developer.

The developing unit 11 consists basically of the development roll 13 accommodating a development magnet 12, two screws 141 and 142 for mixing the developer under agitation, a regulator plate 16 that restricts the amount of developer to be supplied to the development roll 13, a developer guide plate 17, a box 18 for detecting the concentration of toner in the developer, a toner density sensor 19, a toner hopper 20, a toner feed roll 21, and a toner mixer 22. The development magnet 12 is stationary. When the development roll 13 rotates in the direction of the arrow, the developer attracted by magnetism to the roll surface is transported until it contacts the surface of the photoreceptor to have the toner deposited on the latent electrostatic image for developing it. The magnetic poles for the development roll 13 are preferably arranged in such a way that poles of the same polarity face each other in the area where the photoreceptor drum 1 is in close proximity with the development roll 13 as shown in FIG. 1 or 10 because, with this arrangement, the efficiency of development with the developer to be used in the image forming method of the present invention is enhanced and "selective development", or a phenomenon in which those toner particles in the developer which have a specified size and charge quantity are consumed excessively, can be prevented. The reason for these advantages is that either agglomerated fine toner particles can be separated again or fine toner particles with a large quantity of charge that adhere strongly to carrier beads can be detached. When the developer is to be transported by the development roll 13, its quantity is limited to a predetermined level by means of the regulator plate 16 and the excess portion of the developer which is rejected by the regulator plate is returned into the developing unit as it slides down the guide plate 17. An exemplary construction of the guide plate 17 is shown in FIG. 2; the box 18 for detecting the concentration of toner in the developer and the toner density sensor 19 are provided and as the printing operation proceeds to consume the toner, its concentration is detected and the necessary amount of toner to compensate for the loss is supplied by activating the toner feed roll 21. To assist in the flow of the developer within the box 18, a magnet piece 15 is installed in a selected area of the screw 142. The developer flowing down the guide plate 17 is divided into two portions, one that drops down bypass holes 60 to be directed towards the screws 141 and 142 and the other part that is directed towards the container of the toner mixer 22.

Figure 3:
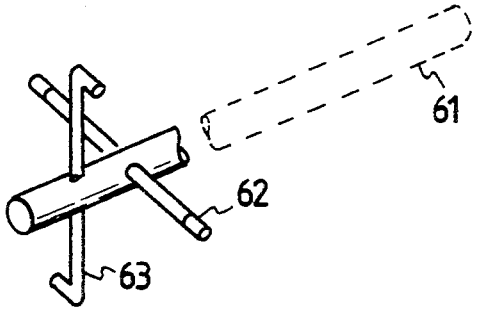
FIG. 3 is a schematic diagram showing an agitating shaft for use in the present invention.

As shown in FIG. 3, the toner mixer 22 comprises a shaft 61 equipped with bars 63 having no magnetic poles that alternate with magnet bars 62 having magnetic poles. The magnet bars 62 attract the magnetic developer toward their opposite ends, so that the developer can be mixed under agitation in the container with higher efficiency. Needless to say, the mixer 22 may comprise the shaft 61 equipped with only bars 63 or magnet bars 62.

The developer directed towards the toner mixer 22 is mixed under agitation by the toner mixer 22 and overflows the container to move towards the screw 142. During this operation, the toner is replenished from the toner feed roll 21. A toner return screw 59 is provided to insure that the toner recovered with a cleaner 45 (to be described later) is returned to the developing unit 11 for another use. As shown in FIG. 1, the developing unit 11 has a motor 232 for driving the development roll 13, and a motor 231 for driving the screws 141 and 142, toner mixer 22 and toner feed roll 21. The toner feed roll 21 is preferably so adapted to be rotated by means of a toner feed clutch 24 only when the toner is replenished. The motor 232 runs at a constant speed. On the other hand, the motor 231 is preferably adapted to run at a faster speed when there is a need to replenish the toner in a large amount, namely in the case where a high-density image needs to be printed, because greater advantages are offered in achieving uniform mixing and agitation of the toner, stabilizing the charging process of toner, and reducing not only the load on the developer but also its deterioration, whereby consistently good image quality can be obtained for both a short and a long period of operation. The amount of toner replenishment can be measured by various methods such as by measuring the density of printed dots on the basis of information to be recorded and measuring the time interval between successive operations of the toner feed roll.

While a toner image can be formed on the photoreceptor drum in the way described above, the carrier beads in the developer can in a rare case be deposited on the photoreceptor drum. The deposited carrier will cause incomplete transfer of the toner image and is preferably removed before the transfer step. To this end, the developing unit 11 is equipped with a carrier cleaner 25 that comprises a stationary carrier cleaning magnet roll 26 and a rotating carrier cleaning sleeve 27 that accommodates it. As it rotates, the carrier cleaning sleeve 27 attracts the carrier from the photoreceptor and returns it to the developing unit 11. The magnetic poles of the carrier magnet roll 26 which are located in close proximity with the photoreceptor's surface are preferably arranged in the manner shown in FIG. 1, i.e., magnetic poles of the same polarity face each other. These magnetic poles are preferably of the same polarity as those provided for the development roll 13. In a more preferred embodiment, no special magnetic poles are provided for recovering the carrier into the developing unit 11 and, instead, the magnetic poles provided on the development roll 13 for recovering and transporting the developer are used to attain that purpose. In this preferred embodiment, the photoreceptor surface can be effectively cleaned of excess carrier and, at the same time, no carrier particles will fly out of the developing unit 11 to move towards the carrier cleaner 25. For improving the efficiency of cleaning, it is particularly preferred to supply the carrier cleaning sleeve 27 with a dc or ac bias voltage or an ac voltage superposed on a dc bias voltage. Shown by 28 is an ac power source $H_4$ for biasing the carrier cleaning sleeve, and 29 is a dc power source $H_5$ for biasing the carrier cleaning sleeve. The ac bias power source 28 may be designed to produce a voltage of 100–1,000 Vrms at 200 Hz–10 kHz, whereas the dc power source 29 may be designed to produce a voltage of ca. 300–1,000 V at the same polarity as the charging of toner (i.e., opposite to the polarity of carrier). It is also preferred that the charges on the photoreceptor surface are attenuated or erased in the carrier cleaning step and, to this end, the photoreceptor is desirably subjected to uniform exposure after development, or alternatively, the vicinity of cleaning magnetic poles is uniformly exposed to light from a fade lamp 30 during carrier cleaning. This uniform exposure to the fade lamp 30 achieves the added advantage of enhancing the efficiency of transfer of the toner image onto the recording sheet while preventing its excessive sticking to the photoreceptor drum, thereby insuring positive separation of the recording sheet from the drum.

The toner image thus formed on the surface of the photoreceptor drum 1 is subsequently transferred onto a recording sheet 31 by means of a belt transfer unit having the construction described below. The recording sheet 31 is guided and transported by a pair of guide rollers 321, a paper guide 322 and a dielectric belt 33 unit it contacts the surface of the photoreceptor drum, whereupon a transfer device 34 is activated to transfer the toner image from the photoreceptor surface onto the surface of the recording sheet. The transfer device 34 consists of a shield casing 36 and a corona wire 35 suspended in its center. The corona wire 35 is supplied with a high voltage from a dc power source to cause corona discharge that provides transfer charges for the dielectric belt 33 just above the transfer device which cooperates with the photoreceptor drum 1 to hold the recording sheet 31 in position. The applicable electric resistance of the dielectric belt 33 is at least $10^6$ Ω.cm and it is preferably made of a semiconducting dielectric having a resistance of $10^9$–$10^{11}$ Ω.cm. It is however difficult to maintain resistance values within this range over an extended period since the corona will deteriorate the dielectric belt or, in a humid condition, moisture is adsorbed on the belt to reduce its electric resistance. To insure a satisfactory efficiency of toner transfer in all cases despite that situation, conductive transfer bias rolls 391 and 392 are preferably provided ahead of and behind the transfer zone, with a constant voltage being applied to those rolls. In the embodiment shown in FIG. 1, a constant-voltage (300–1000 V) element $Z_5$ 40 is connected to the bias rolls 391 and 392 to utilize the voltage that results from leakage current. If the roll 392 is positioned below the paper guide 322, it offers the added advantage of attracting the recording sheet in such a way that it is transported smoothly. The transfer belt is driven with rolls 381 and 382 and, preferably, at least the drive roll that is located closer to the sheet eject side is grounded. With this arrangement, any residual charges on the belt can be erased to facilitate not only the separation of the recording sheet from the belt but also the removal of excess toner particles deposited on the belt. Instead of providing the single constant-voltage element $Z_5$, the transfer bias rolls 391 and 392 may be supplied with different voltages from two separate constant-voltage elements. For instance, the bias roll 392 may be connected to an 800-V supplying element whereas the bias roll 391 is connected to a 500-V supplying element. Alternatively, a constant-voltage (300–1000 V) power source or a high-resistance (50–500 MΩ) element may be connected to the bias rolls. Desirably, the pair of guide rollers 321 and the paper guide 322 are also supplied with a bias voltage by the same means as adopted for the transfer bias rolls 391 and 392.

The above procedure permits the toner image to be transferred from the photoreceptor drum onto the recording sheet. However, toner or paper particles will inevitably be deposited on the transfer belt and if they build up, either normal transfer can become impossible or the recording paper may be fouled. To avoid these problems, after the recording sheet 31 has been separated from the dielectric belt 33, a cleaning web 41 is pressed into contact with the belt 33 by means of a press roller 42 so as to remove unwanted toner and paper particles. In place of the cleaning web 41, unwanted toner and paper particles may be removed with a cleaning brush or a cleaning brush. A "field brush" cleaning method in which an electric field is applied to a brush flocked with semiconductor fibers ($10^6$–$10^{12}$ Ω.cm) is a particularly preferred approach since it exerts less mechanical load on the transfer belt to thereby extend its useful life.

The toner that still remains on the photoreceptor drum 1 after the transfer step has to be removed before the next image forming cycle starts. For efficient removal of the residual toner, the cleaning step of the image forming process of the present invention is preceded by supplying said residual toner with corona charges of the same polarity as the charging of toner using a precleaning charger 43 and a power source 44 for the precleaning charger. If, in this case, the photoreceptor drum 1 is illuminated with uniform light (second fading light which is not shown) either simultaneously with or after charging, not only can charges be selectively imparted to the toner but it is also possible to reduce the effects of reverse charging in the transfer zone. A dc voltage or an ac voltage superpower on a dc bias may be applied to the precleaning charger 43. In case of using a negatively charged toner, only an ac voltage may be applied, since the discharge characteristics of the ac voltage permits negative charging. The optical image beam 9 and the fade lamp 30 or the second fading light or the light of an erase lamp 58 to be described later which are to be combined with the beam 9 are selected to have such wavelengths that, upon illumination, the optical fatigue of the photoreceptor can be either compensated for or reduced. Consider, for example, the case where an organic photoconductor or an amorphous silicon photoconductor is used as the photoreceptor and light from a semiconductor laser operating at 600–850 nm or from a light-emitting diode (LED) is used as the optical image beam; then, the second fading light or the light from the erase lamp 58 preferably has a different dominant wavelength (in the green to blue region). If the fade lamp 30 is not used, the wavelength of the second fading light may be within the same region as the optical image beam.

After the process described above, the residual toner on the surface of the photoreceptor drum 1 is removed with a cleaner 45. The housing of the cleaner 45 accommodates a semiconducting brush 46 for removing the residual toner from the drum 1, a toner recovery roll 48, and other components. The semiconducting brush 46 comprises a conductive cylindrical substrate flocked with semiconducting fibers ($10^6$–$10^{12}$ Ω.cm) either alone or in combination with insulating fibers. The brush 46 is supplied with a voltage of 100–1,000 V of opposite polarity to the charging of toner from a cleaning bias power source 47. The brush 46 is capable of rotating in contact with the surface of the photoreceptor. Upon application of that voltage, an electric field is exerted on the residual toner so that it is attracted towards the brush 46. Subsequently, the brush 46 makes contact with the rotating conductive toner recovery roll 48. A power source 49 supplies a toner recovery bias voltage between the semiconducting brush 46 and the toner recovery roll 48; this voltage has an opposite polarity to the charging of toner and its potential gradient is such that the toner recovery roll 48 has a higher potential than the semiconducting brush 46. The voltage applied between the brush 46 and the roll 48 is in the range of 100–1,000 V. This voltage causes the toner adsorbed on the semiconducting brush 46 to be transferred onto the toner recovery roll 48. The toner transferred to the recovery roll 48 is scraped off with a toner scraper 51, carried to the outside of the cleaner housing by means of a toner recovery screw, and returned to the developer via toner return screws 52 and 59 for another use or collected in waste toner bottles (not shown). In the cyclic use of toner, if extraneous paper particles or scrap fibers get into the toner in the image forming process, the charging characteristics of the toner or its power characteristics can deteriorate or image defects may be introduced. A paper particle blocking sponge 50 is provided for the purpose of removing this foreign matter by lightly pressing it against the toner recovery roll 48. It will be convenient to integrate the semiconducting brush 46 and the sponge 50 into a unitary assembly that can be detached for replacement as the useful life of the brush or sponge expires. In the "field cleaning" method described above which uses the semiconducting brush, if moisture condenses on the drum surface as the result of a change in the environment in which the printer is operated, water drops will be deposited on the brush and its cleaning action may deteriorate considerably, particularly in terms of its ability to remove fine toner particles. A dehumidifying heater 53 is provided to remove those water drops. When a dew sensor 56 detects a potentially condensing environment on the basis of the temperature vs humidity relationship, a switch 55 is activated to establish connection between the heater 53 and a heater power source 54. In this way, the residual toner can be efficiently removed from the photoreceptor surface by means of the cleaner 45. According to the system shown in FIG. 1, the cleaning step is preceded not only by the pretreatment involving uniform charging or light illumination but also by the "field cleaning" with a semiconducting brush and, therefore, fine toner particles, reversely charged toner particles, weakly or abnormally strongly charged toner particles, externally added aids or foreign materials such as paper particles, all these having been difficult to remove by the prior art, can be totally rejected from the photoreceptor to such an extent that the photoreceptor is conditioned to be ready for use in the next image forming cycle. The photoreceptor drum 1 that has been cleaned or residual toner by the cleaner 45 is subjected to the last erase step, in which residual charges or the residual memory in the light-sensitive layer is removed by flooding with the erase lamp 58. This erase step may be omitted if its purpose can be achieved by the fade lamp 30 or the second fading light.

The toner image forming method of the present invention has been described above with reference to the case where it is applied to the system shown in FIG. 1 and this embodiment has the advantage of consistently producing a fine image over an extended period. FIGS. 2 and 3 respectively show preferred versions of the developer guide plate 17 and the toner mixer 22 used in the developing unit shown in FIG. 1.

We now describe the developer that is suitable for use in the above-described image forming method which is capable of producing fine images in a consistent manner over a prolonged period. While that method is capable of producing satisfactory image even if the conventional developers are used, the best result is obtained with the following developer. Needless to say, the developer described below can also be used in the prior art image forming methods. For producing a fine or high-resolution image, the magnetic carrier beads to be used in the developer are required to have a high carrier density and be aligned into soft bristles when they form a magnetic brush in the development region. To meet this requirement, the carrier beads desirably have an average size of 30–200 μm, (especially 70–120 μm) and a saturation magnetization of no more than 100 emu/g (especially 10–50 emu/g). A further requirement is that the carrier undergo triboelectrification with the toner rapidly (i.e., fast rise time) and that when the toner particles contact or separate from the carrier beads, charges are accordingly generated or lost from the surfaces of the latter. It is also required to prevent the deposition of carrier beads on the photoreceptor (due to electrostatic attraction) so that the bias voltage applied to the development roll 13 will not undergo shorting or other troubles to produce a leakage current. Furthermore, appropriate toner exchange between the surface and the interior of the magnetic brush desirably occurs in the development region. In order to satisfy these requirements, the carrier beads are preferably in a generally spherical form (flat shapes are not desirable) and, in terms of electric properties, they are preferably semiconducting with an electric resistance of $10^6$–$10^{11}$ ωcm, with the range of $10^8$–$10^9$ Ωcm being particularly preferred. The core of the carrier beads advantageously has a resistance in the semiconducting or insulating region ($10^8$–$10^{13}$ Ωcm). In other words, carrier beads that comprise conductive (low resistance) cores surrounded by shells to provide an overall semiconducting property are not suitable for use in the present invention.

Figure 4A:
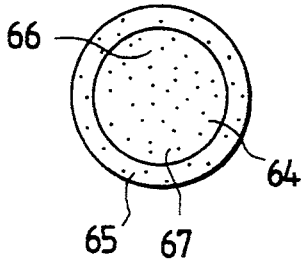
FIGS. 4 and 5 are schematic diagrams showing examples of the developer to be used in the present invention.
Figure 4B:
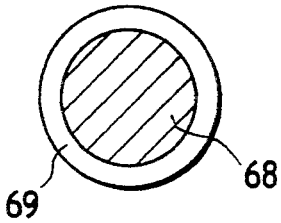

FIGS. 4*a* and 4*b* show two examples of a carrier bead that is suitable for use in the above-described image forming method of the present invention. The carrier bead shown in FIG. 4*a* consists of a core 64 having magnetic particles dispersed in a binder resin and a shell 65. This structure is suitable for making carrier beads with an average size of ca. 50 μm. The core 64 comprises a binder resin 66 such as an acrylic resin, polystyrene, polyester or silicone which have dispersed therein 30–80 wt % of magnetic particles of ferrite, magnetite, nickel, nickel oxide, ion, etc. that have an average size of 0.1–1 μm. In the actual production of carrier beads having the structure shown in FIG. 4*a*, aids are sometimes used to achieve uniform mixing or dispersal. The core 64 is prepared by a process that comprises mixing a resin, a magnetic powder and any other necessary components, melting the mixture, kneading the melt, cooling it to solidity, pulverizing the solidified product, and classifying the particles. Subsequently, a shell composition is added and caused to adhere to the surfaces of the cores. Thereafter, the combination of the cores with the shell composition is passed through a hot atmosphere and subjected to spheroidization, whereby a shell 65 is formed around the core in a thickness of 0.05–2 μm. The shell composition typically comprises a magnetic powder of the type described above, carbon particles, a charge control agent (e.g. a nigrosine dye, pyridinium salt, a complex monoazo salt or a phthalocyanine pigment), and a resin powder. The carrier beads thus produced have the advantage that their magnetization characteristics can be properly adjusted by controlling the kind and amount of the magnetic material in the core and that their electric resistance and triboelectricity characteristics can also be adjusted by controlling the recipe of the shell composition and the conditions of heat treatment adopted for spheroidization.

FIG. 4*b* shows a carrier that comprises a magnet core 68 that is made of a high-resistance, low-magnetization material such as ferrite or magnetite and that is coated with a semiconducting shell 69. The semiconducting shell 69 can be formed by coating a composition that has a charge control agent and a resistance modifier added to a binder resin such as an acrylic resin, polystyrene, silicone or a polyester. The structure shown in FIG. 4*b* is suitable for making carrier beads with an average size of ca. 100 μm. Aspirates in the form of wrinkles are preferably formed on the core surface of the carrier beads.

For convenience sake, the carrier beads are shown to be spherical in FIGS. 4*a* and 4*b*. It should, however, be noted that the surfaces of those carrier beads preferably have aspirates in the form of wrinkles rather than being smooth not only for the purpose of stabilizing the quantity of charges on the toner but also for reducing the deposition of carrier beads on the photoreceptor.

Figure 5:
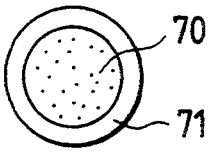

As described hereinafter, the toner component of the developer for use in the image forming method of the present invention is characterized by containing at least 30 wt % of particles with a size of no more than 8 μm in order to form a fine image. Preferably, part or all of the toner component is comprised of generally spherical particles. It is also desirable for the toner particles to have the structure shown in FIG. 5 in order to control the charging characteristics and electric resistance of the toner. The toner particle shown in FIG. 5 consists substantially of a core 70 and a shell 71. The core 70 contains as essential components a binder resin such as polystyrene, an acrylic resin or a polyester, carbon particles (5–10 wt %) and a charge control agent (5–10 wt %). The shell 71 contains a charge control agent in a greater amount (1–5%) than does the core 70. The shell 70 contains carbon in an amount that is equal to or less than its content in the core 70. The binder resin in the shell 71 may be the same as that used in the core 70 or, alternatively, it may have a slightly higher melting point. The toner having the structure shown in FIG. 5 can be prepared by the pulverizing/spheroiding technique employed to make the carrier bead shown in. FIG. 4*a* or by microencapsulation techniques such as suspension polymerization. The charging characteristics of the toner can be properly adjusted by controlling the kind and type of the charge control agent contained in the shell 71, and the electric resistance and fixing characteristics of the toner can be adjusted by controlling the carbon content. A balance among the fixing, storage and flow characteristics of the toner can be attained by properly adjusting the thermal characteristics of the individual resins to be used. While the appropriate quantity of charges on the toner varies with the specific development system to be adopted, a suitable value is within the range of 10–30 μC/G in the embodiment shown in FIG. 1 (see the description that follows). The appropriate value for the electric resistance of the toner is within the range of $10^{13}$–$10^{15}$ Ωcm. When the above-described carrier and toner are mixed to form a developer, the proportion of the toner is typically in the range of from 1 to 30 wt % and the toner coverage of the surface area of carrier beads preferably ranges from 0.2 to 0.6. In addition to the carrier and the toner, the developer may sometimes contain externally added agents in small amounts for improving its fluidity, as well as for adjusting electric resistance and charging characteristics.

Figure 6:
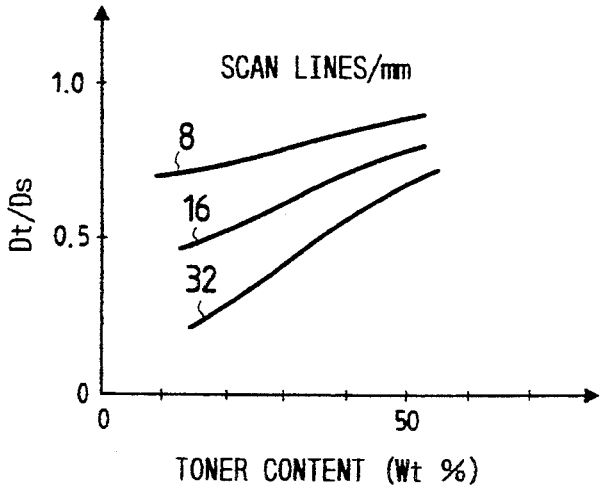
FIG. 6 is a graph showing the relationship between toner proportion and image reproduction.

The size of toner particles as it relates to the use of the above-described developer in the image forming method of the present invention for producing a fine image is discussed specifically below. FIG. 6 is a graph showing the reproduction of fine lines (Dt/Ds) vs the proportion of toner particles not larger than 8 μm. The reproduction of fine lines (Dt/Ds) was determined as the ratio to the image density of thick lines (5 mm in width). When Dt/Ds is nearly equal to 0.3, fine lines can be recognized as such, and if Dt/Ds is equal to or greater than 0.5, fine lines can be reproduced as a sharp image. As one can see from FIG. 6, the small toner particles must be contained in an amount of at least 30 wt % in order for 16–32 scan lines to be reproduced with Dt/Ds values nearly equal to or greater than 0.5. The toner image composed of the small particles is preferred since it has a sufficient covering power for the recording sheet to achieve a high image density. On the other hand, the small toner particles can potentially lower the fluidity of the developer, slow down the rise time for triboelectrification, or reduce the efficiency of transfer with a belt transfer device. Under the circumstances, it is more preferred to use nearly spherical toner particles ($1<R<1.5$; R is the degree of sphericity or the ratio of the major axis of a toner particle to its minor axis). To avoid the problems mentioned above, it is particularly desirably to incorporate ca. 10–20 wt % of toner particles having a size of 10–30 μm.

Figure 7:
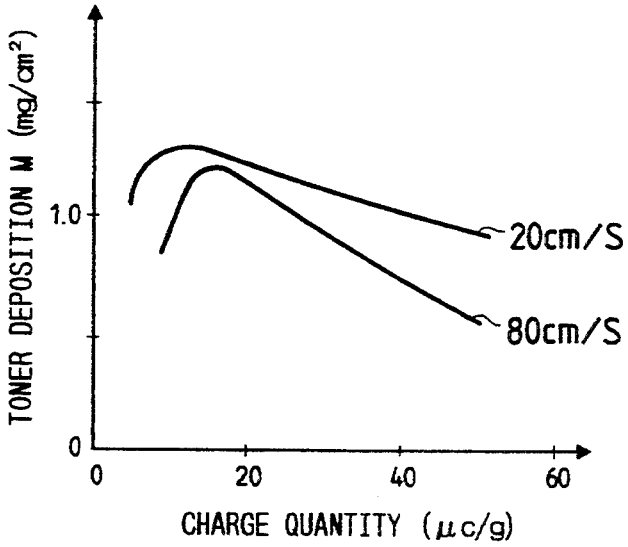
FIG. 7 is a graph showing the relationship between the quantity of electric charges on toner particles and the amount of toner deposited for development.

FIG. 7 shows the amount of toner deposited for development vs the quantity of charges on toner used in the image forming method of the present invention. The amount of toner deposition (M) peaks when the quantity of charges on toner is in the range of ca. 10–20 μC/g. For a given value of M, the quantity of charges on the toner increases with the speed of the development process (the peripheral speed of the drum). On the other hand, the amount of toner deposition (M) tends to decrease with the process speed. The range lower than 10–20 μC/g is an "unstable region" where more of the toner will scatter from the developer. From these considerations, one can conclude that the appropriate quantity of charges on toner is within a range that is slightly higher than the region where M peaks; to take a process speed of 80 cm/s as an example, the appropriate range is from 20 to 30 μC/g. In order to prevent toner scattering and to insure print stability, it is particularly important in the case of high process speeds to select a range that is 5–10 μC/g higher than the region where M peaks.

FIG. 7 refers to the case where the toner coverage of carrier beads (Ct) is 0.3 but it should be mentioned that essentially the same tendency is observed within the range of Ct=0.2–0.7. If Ct is high or in the case of a developer that contains many small toner particles, the rise time of triboelectrification will slow down or it becomes difficult to achieve uniform mixing of carrier and toner under agitation, whereby the chance of toner scattering or image fogging will increase. If these phenomena are likely to occur, it is important to adopt the methods of toner replenishment and agitation already described with reference to FIG. 1 for preventing those problems.

In the next place, we describe, with reference to FIGS. 8–14, modifications of the method of detecting the concentration of toner in the developer and the cleaning method that are suitable for use with the image forming method of the present invention, as well as the developing unit and the fixing unit.

Figure 8:
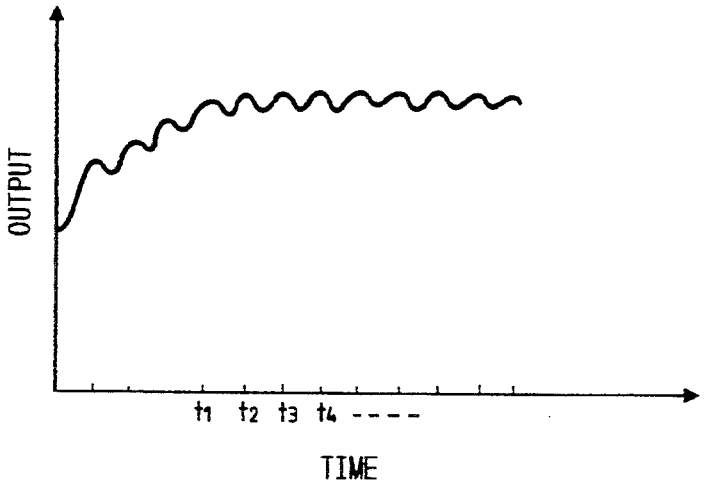
FIG. 8 is a diagram showing the detection output from a toner density sensor.

The developing unit used in the image forming apparatus shown in FIG. 1 has the sensor 19 for measuring the concentration of toner in the developer. As shown in FIG. 8, the detection output of this sensor experiences periodic variations as the screw 142 rotates. This is because the speed at which the developer flows out of the toner density detecting box 18 will vary slightly on account of the agent piece 15 which is attached to the screw 142 for insuring that the developer will positively flow out of the box 18. To minimize the detections error that can occur on account of that speed variation, the following method may be adopted: after the passage of a given time $t_1$ from the start-up of the developing unit, the profile of toner density is checked in terms of the detection outputs that are produced at times $t_2$, $t_3$, $t_4$ . . . which are synchronous with the period of the cyclic variations under consideration. Times $t_2$, $t_3$, $t_4$ . . . can be measured by detecting the position of the rotating screw 142 at regular intervals.

Figure 9:
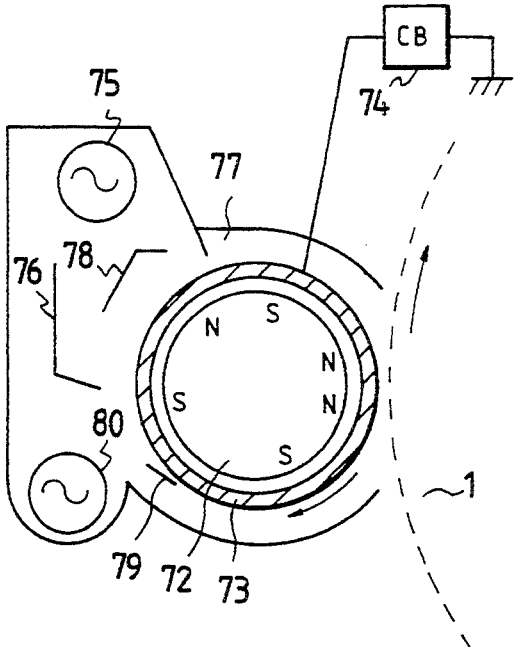
FIG. 9 is a schematic diagram showing a modification of the cleaning unit used in the present invention.

FIG. 9 shows a modification of the cleaning unit which is used to remove residual toner that, stays on the photoreceptor drum after the toner image has been transferred onto the recording sheet. According to this modified version, a magnetic brush is formed with the developer as in the case of the developing unit shown in FIG. 1 and the photoreceptor is rubbed with this brush under the action of an electric field to remove residual fine toner particles which are generally difficult to remove by the prior art. The magnetic brush is formed by adsorbing the developer on a magnetic brush cleaning sleeve 73 which is fitted over a stationary cleaning magnet 72. When the conductive cleaning sleeve 73 rotates in the direction of arrow, the magnetic brush rotates accordingly. The cleaning sleeve 73 is connected to a cleaning bias power source 74 which supplies an ac voltage, or a dc voltage of the same polarity as the charging of toner, or an ac voltage superposed on that dc voltage. The voltage to be applied to the cleaning sleeve 73 is selected to lie within the range of 200–1,500 V at a peak value. The cleaning sleeve 73 preferably counter rotates with respect to the photoreceptor drum. The efficiency of cleaning is improved if the magnetic poles in the area of the cleaning magnet 72 which is in close proximity to the drum surface are arranged in such a way that poles of the same polarity face each other. The developer in the developing unit is admitted into the cleaning unit by means of a feed screw 75 and drops down a guide plate A 76. The developer is then attracted to the surface of the cleaning sleeve 73 and as it rotates, the developer is transported while it is smoothed to a given thickness by means of a regulator plate 77. Excess developer drops down a guide plate B 78 and the guide plate A 76 where it collects to be attached again to the surface of the cleaning sleeve 73. As the cleaning sleeve 73 rotates, the developer shaped by the regulator plate 77 is transported until it contacts the photoreceptor drum to remove the residual toner both mechanically and electrically. Thereafter, the developer is detached from the cleaning sleeve 73 by means of a scraper 79 and part of the detached developer collects in the lower part of the container whereas the remainder is attracted to the cleaning sleeve 73 once again. The amount in which the developer is attracted to the cleaning sleeve 73 is regulated by the guide plate A 76. After repeated cycles of the image forming process, the developer accumulating in the lower part of the container overflows it and is returned to the developing unit by means of an eject screw 80 for another use in the development step. Thus, the toner removed from the photoreceptor drum can be subjected to repeated use. The cleaning unit described above is so constructed that a constant amount of developer is kept circulating around the cleaning sleeve and, therefore, even if the supply of the developer from the developing unit is erratic or interrupted temporarily, there will not be caused any unevenness or sudden drop in the cleaning performance.

FIGS. **10*a*–10*d* show four examples of the construction that is suitable for the development magnet 12 used in the development roll in the developing unit. The development roll indicated by 13 in FIG. 10*a* may be formed of a nonmagnetic conductor such as aluminum or stainless steel, which is preferably provided with asperities on the surface that are 0.05–0.5 mm deep and that are spaced by an average distance of 0.1–1 mm. Such surface asperities are provided in order to insure that the developer using carrier beads of low saturation magnetization which are suitable for implementing the image forming method of the present invention will be transported positively. The surface area of the development roll 13 desirably has an electric resistance of $10^8$–$10^{11}$ Ωcm. This electric resistance is for the purpose of preventing charged small toner particles from being attracted electrostatically on account of their developing power to form a thin film. An advantageous example of the development roll that satisfies all of these requirements is an aluminum sleeve that is surface-grained by anodization to form a satiny alumina layer in a thickness of 10–50 μm. As for the development magnet 12, magnetic poles 811, 812, and 813 are important and are responsible for transporting the developer and developing the latent electrostatic image in the area where the magnet 12 contacts the photoreceptor. In the image forming method of the present invention, it is necessary that a developer that has a high content of small toner particles and that contains carrier beads of low saturation magnetization be used to prevent not only selective development but also the deposition of carrier beads on the photoreceptor. To meet this need, the movement of carrier beads that form a magnetic brush in the development region, in particular the movement (disturbance) of the upper and lower layers of the brush and its right- and left-hand portions, is preferably promoted only to enhance the efficiency of development but also to reduce the chance of the formation of bare (uncoated) carrier beads. Under the circumstances, magnetic poles 811 and 812 of the same polarity are provided and each is desired to produce an increased flux density of 700–1,200 gauss whereas magnetic pole 813 of opposite polarity is provided to produce a lower flux density of 50–500 gauss. This results in the arrangement of magnetic poles for development that has a large pole width, that promotes the rotation of the magnetic brush in the development region and that causes great variations in magnetic force, whereby the development of a latent electrostatic image can be accomplished with higher efficiency while effectively preventing the deposition of carrier beads on the photoreceptor. This means that the transport speed of the developer can be sufficiently slowed down to reduce the dusting of the developer having a high content of small toner particles, whereby the useful life of the developer can be extended. A more preferred magnetic pole arrangement is such that the magnetic pole 811 is adapted to have a higher flux density than the magnetic pole 812 if the photoreceptor drum is designed to rotate passing over the magnetic pole 811 first and then magnetic pole 812. Since the magnetic pole 811 has a higher flux density, the density of the magnetic brush and hence the field strength in that area increases accordingly to improve the developability of a large-area image. On the other hand, the magnetic brush formed in the area corresponding to the magnetic pole 812** has a sufficiently low density to improve the reproduction of line drawings. In this way, an image can be obtained that has a good balance between the reproduction of large-area images and that of line drawings.

Figure 10A:
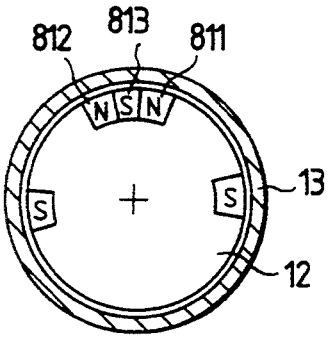
FIG. 10 is a schematic diagram showing various constructions of a magnet in the development roll used in the present invention.
Figure 10C:
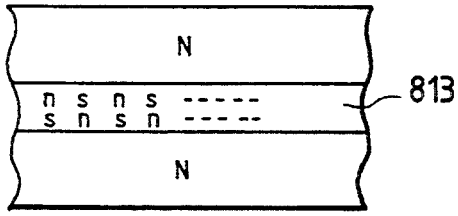
Figure 10B:
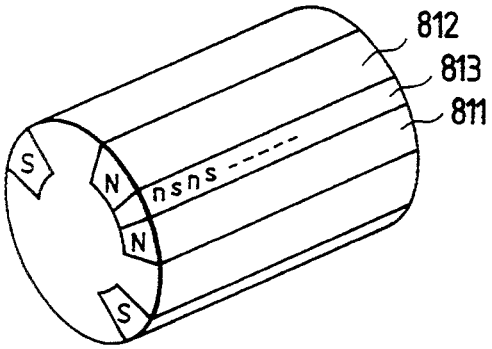

FIG. 10*b* shows another example of the preferred development magnet. As shown, the magnetic pole 813 comprises a plurality of small magnets (50–500 gauss) that are arranged in such a way that poles N and S alternate in the axial direction. With this arrangement, the developer that forms a magnetic brush in the development region can be effectively moved not only back and forth but also up and down and vice versa to insure that the efficiency of development is improved while minimizing the deposition of carrier beads on the photoreceptor.

FIG. 10*c* shows another modification of the magnetic pole 813 which comprises an array of small magnets s and n of opposite polarity that alternate with each other as shown to produce the same result as the embodiment shown in FIG. 10*b*.

Figure 10D:
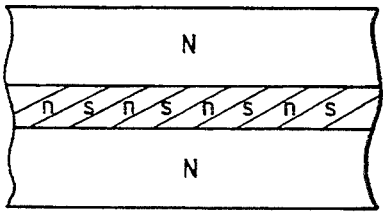

FIG. 10*d* shows still another modification of the magnetic pole 813 which comprises an array of oblique small magnets s and n of opposite polarity that alternate with each other as shown to produce the same result as the embodiment shown in FIG. 10*b*.

When either one of the development rolls shown in FIGS. 10*a*–10*d* and the developer already described above were used in the system shown in FIG. 1, the development gap between the magnetic brush and the photoreceptor could be reduced to 1–2 mm where the two parts barely touched each other and yet a high-density image could be obtained without perceivable drop in resolution. Further, a tolerance of up to ca. ±0.2 mm was allowed for the precision of the development gap.

After the toner image on the surface of the photoreceptor drum has been transferred onto the recording sheet, it is permanently fixed by the following procedure. The high image quality reproduced by the development and transfer steps should not be affected in any adverse way in the fixing step. Therefore, in order to fix the transferred toner image with heated rolls, it is important among other things to control their temperature at a constant level. Otherwise, dropouts or staining due to offsetting, a lower resolution at elevated temperatures or incomplete fixing at low temperatures will occur. A further requirement of the fixing step is that the heating rolls have an appropriate surface state.

Figure 11A:
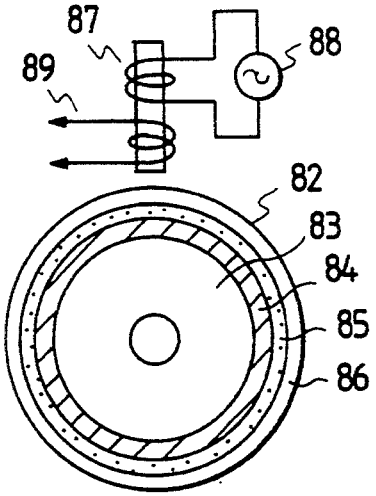
FIG. 11 is a schematic diagram showing examples of the construction of the heating roll for use in the present invention.
Figure 11B:
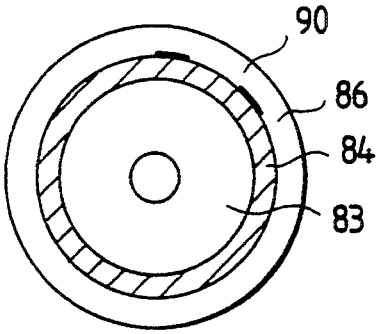

FIGS. 11*a* and 11*b* show two examples of the heating roll that is so constructed that its temperature can be detected in a contactless and rapid (high response speed) way to minimize the resulting temperature variations. The heating roll shown by 82 in FIG. 11*a* has in its center a heater lamp 83 for heating said roll. The heating roll 82 comprises a core roll 84 made of a metal such as aluminum, copper or stainless steel, which is coated with a magnetic layer 85 (1–1,000 μm) made from magnetic particles (0.3–2 μm) such as ferrite or magnetite particles that have a Curie point of 80°–230° C. and that are either fused together or dispersed in a heat-resistant binder resin, which magnetic layer 85 in turn is overlaid with an elastic layer 86 made from a fluorine resin to a thickness of 10–500 μm or silicone rubber to a thickness of 0.1–2 mm. With this arrangement, the magnetic layer 85 will lose its magnetic characteristics at the Curie point, so compared to temperature sensors of a contact type such as a thermistor, the temperature of the heating rolls can be detected and controlled more rapidly by sensing that event. In addition, the magnetic layer can be formed either on the entire surface of the core roll 84 or in selected areas in the axial direction, so not only is there a great latitude in determining the position where the sensor 87 should be set but also the temperature of the heating roll 82 can be detected even if it is at rest. The sensor 87 is preferably located centrally in the axial direction of the heating roll because this helps provide a uniform temperature profile for the roll. In this case, the magnetic layer may be provided only in the center of the core roll. Since the temperature to be detected and controlled in the embodiment under discussion is determined by the Curie point of the magnetic material in the magnetic layer 85, the appropriate magnetic material must be selected in consideration of the temperature necessary for fixing the toner image. If one desires to control the temperature of the heating roll at varying levels in accordance with the specific type of the recording apparatus that uses said heating roll, one may provide as many magnetic layers of different Curie points as are necessary for selecting among the temperature levels of interest side by side on the surface of the core roll in its axial direction and one of those magnetic layers is selected in accordance with the temperature to be controlled.

One method that can be used to detect the temperature of the heating roll is also shown in FIG. 11*a*. That is applying a high-frequency voltage to the primary coil 88 on the detector 87 having two coils and monitoring the voltage induced from the secondary coil 89. In order to make the precision of detection less susceptible to the effects of the position in which the detector 87 and the heating roll 82 are set, the following method should preferably be used: a capacitor is connected in parallel or series to the secondary coil to form a resonant circuit and, with a high-frequency voltage being applied to the primary coil, the resonance frequency is detected by a continuous sweep over the frequency range containing that resonance frequency. According to this method, the resonance frequency peaks at the Curie point of the magnetic material. Thus, one can detect that, the temperature of the heating roll of interest has reached the Cure point. Thereafter, the application of power to the heater lamp 83 is ceased and when it is confirmed that the temperature of the heating roll has dropped below the Curie point, power is again supplied. By repeating this procedure, the temperature of the heating roll can be held at a constant level.

FIG. 11*b* shows another example of the heating roll that can be used in the present invention. In the embodiment shown in FIG. 11*a*, the magnetic layer for detecting the temperature of the heating roll is provided on the entire circumference of the core roll 84. In the embodiment shown in FIG. 11*b*, the magnetic layer indicated by 90 is provided in one or more areas on the circumference of the core roll. If the magnetic layer 90 is to be provided in more than one area, different temperatures of the heating roll can be detected by using magnetic materials having different Curie points. When the heating roll of the type shown in FIG. 11*b* rotates, a pulsive signal is obtained from the detection coil and at the Curie point, the signal intensity becomes so low that one can realize that the temperature of the heating roll has reached the Curie point. It is therefore recommended that the temperature control mechanism be adapted to remain inactive when the heating roll is at rest.

Figure 12:
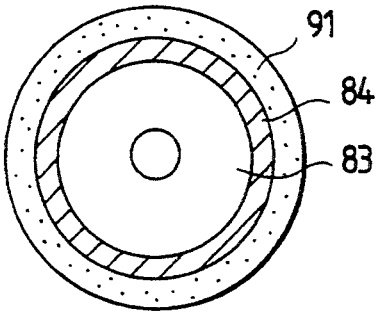
FIG. 12 is a schematic diagram showing another example of the heating roll used in the present invention.

FIG. 12 shows still another example of the heating roll. As shown, it comprises a heater lamp 83, a core roll 84 and an elastic layer 91. The filler in the elastic layer 91 consists of a magnetic powder having a given Curie point which is used either alone or in combination with another filler. The elastic material and the magnetic material used in the embodiment shown in FIG. 12 may be the same as those described in connection with the embodiment shown in FIG. 11*a*. With the arrangement shown in FIG. 12, not only is it possible to perform a contactless measurement of the temperature of the heating roll (especially the elastic material per se) but also the heat conductivity of the elastic layer 91 can be increased, whereby the temperature of the heating roll can be controlled while experiencing reduced fluctuations. In addition, the electric resistivity of the elastic layer can be sufficiently reduced to prevent static buildup that would otherwise cause "offsetting" (i.e., the attraction of toner image to the roll surface by electrostatic force), as well as the winding of the recording sheet onto the roll by electrostatic force. As a consequence, a satisfactory image can be formed on very thin recording sheets without causing any unevenness in image quality or lowering the image resolution.

Figure 13:
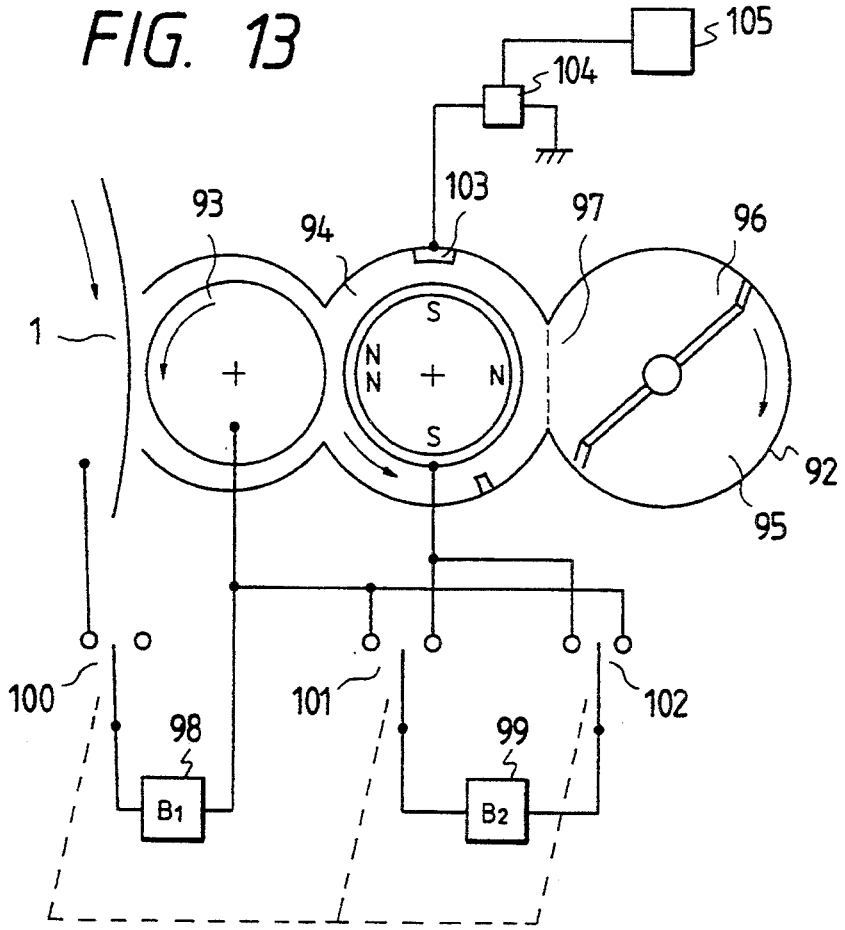
FIGS. 13 and 14 are schematic diagrams showing the constructions of developing units that are adapted to the practice of the present invention.
Figure 14:
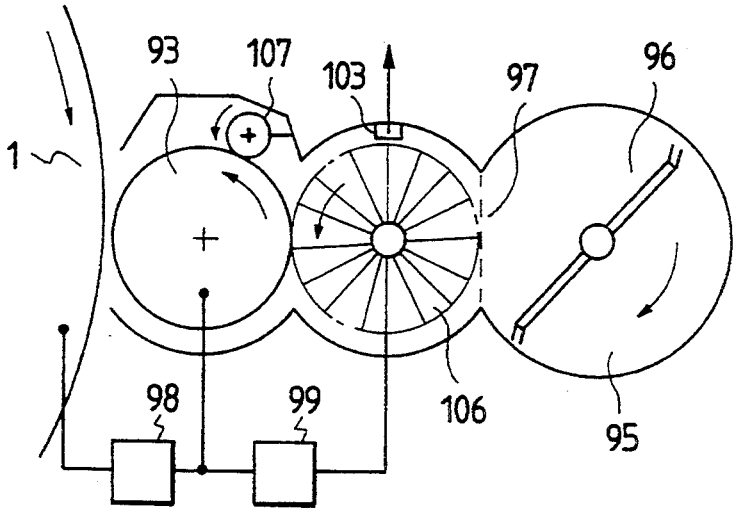

FIGS. 13 and 14 show applications of a toner and a developer that are suitable for use in the image forming method of the present invention with particular reference being made to the construction of the applicable developing unit.

In the case shown in FIG. 13, a latent electrostatic image formed on the surface of a photoreceptor drum 1 is made visible by means of a development roll 93 comprising a conductive substrate that is optionally provided on its surface with a semiconducting dielectric layer. Two to five layers of toner particles are coated onto the surface of the development roll 93 by means of a toner coating magnetic brush roll 94. The magnetic brush roll 94 is of the same type as what is used in the developing unit described in connection with FIG. 1. The magnetic brush is formed as the developer consisting of a magnetic carrier and a toner is transported and the thus formed magnetic brush is brought into contact with the surface of the development roll 93 to provide a toner coating on it. The concentration of toner in the developer is detected with the combination of an electric resistance detecting electrode 103 and an electric resistance detector 104. When a resistance below a predetermined level is detected, a toner replenishing fin 96 is rotated with a drive motor 105 so that the toner in its container 95, as it is pushed by the fin 96, is forced through openings in a mesh separator 97 to be taken up by the developer. Since it is in contact with the separator 97, the developer can incorporate the toner.

Bias power sources $B_1$ 98 and $B_2$ 99 respectively supply voltages between the photoreceptor drum 1 and the development roll 93 and between the development roll 93 and the magnetic brush roll 94. As in the embodiment shown in FIG. 1, the voltages to be applied are either a dc voltage or an ac voltage superposed on a dc voltage and they are applied through bias select switches 100, 101 and 102. In a development mode, these switches are connected to the contacts on the left side as viewed in FIG. 13 and the polarity of the applied bias voltage is so set that the toner is coated from the magnetic brush roll 94 onto the development roll 93 and further towards the photoreceptor. The development roll 93 is so adjusted that it is in close proximity to or makes light contact with the photoreceptor drum 1. While the latent electrostatic image on the surface of the photoreceptor drum 1 is developed in the way described above, the performance of the development roll 93 will gradually deteriorate if such development is continued for an extended period. Even in the absence of continued development, if the toner coating is left as it is on the surface of the development roll 93, it may stick or adhere strongly onto the roll's surface or its charging characteristic may vary to such an extent that the roll 93 will not exhibit the intended performance in a subsequent step of development.

To avoid these problems, the following action is taken in the embodiment shown in FIG. 13. After the end of the development step (i.e., after the image cycle for each page or after the continuous printing process) or at the time when the performance of the development roll 93 deteriorates during the continuous printing process, the switches 100, 101 and 102 are connected to the contacts on the right side as viewed in FIG. 13, whereby changing the bias voltages in such a way that the toner coated on the surface of the development roll 93 will be carried away towards the magnetic brush roll 94. This method insures that an image of high quality can be produced over an extended period.

FIG. 14 shows another embodiment in which the toner that can be used in the image forming method of the present invention is applied to a developing unit that performs development without using a magnetic carrier. This embodiment differs from that of FIG. 13 as regards the method of coating a toner onto the surface of the development roll 93. In this embodiment, a toner is transferred and coated by means of a fur brush 106 onto the surface of the development roll 93 under application of a bias voltage from a bias power source $B_2$ 99. The fur brush 106 is flocked with semiconducting fibers having an electric resistance of $10^7$–$10^{11}$ Ωcm. In order to produce a uniform toner layer and to promote its electrification, a squeeze roller 107 is positioned in close proximity to or in light contact with the development roll 93. The squeeze roller 107 may be used in the embodiment shown in FIG. 13. As in the embodiment shown in FIG. 13, the fur brush 106 is supplied with the toner as it is forced through openings in the mesh separator 97. The amount of toner deposition on the fur brush 106 can be correctly controlled if its detection is based on the measurement of the electric resistances of the fur brush 106 and the electrode 103. The developing units shown in FIGS. 13 and 14 will cause less toner to be scattered about to go outside the units, so they permit the use of toners of smaller charge quantity 2–5 μC/g).

If color recording is to be performed by the image forming method of the present invention, a dense toner image having good color reproduction and high resolution can be obtained with overlapping toner transfer being accomplished satisfactorily by a multiple transfer process. Further, satisfactory over-development characteristics can be obtained if contactless, multiple development is performed using the developing unit shown in FIG. 13 or 14.

As described on the foregoing pages, the image forming method of the present invention uses a developer that has a high content of small toner particles and the dispersal and mixing of small toner particles is sufficiently promoted during development to prevent "selective" development and the deposition of carrier beads onto the photoreceptor so that the developed toner image can always be transferred with high efficiency while, at the same time, the transferred image can be fixed without causing deterioration in its resolution and without leaving any residual fine toner particles on the photoreceptor. Because of these advantages, the present invention offers a printer that is capable of producing a finer image than in the prior art while extending the life of both the developer and the photoreceptor.

What is claimed is:

1. A method of forming an image on a recording sheet, said method comprising the steps of:

preparing a developer including a non-magnetic toner and a magnetic carrier said toner having at least 30 wt % of toner particles having an average particle size of less than 8 μm, spherical degree of not less than 1 and not more than 1.5, magnetic carrier particles of said magnetic having an average particle size of not less than 70 μm and not more than 120 μm, saturation magnetization of less than 100 emu/g, an electric resistance of not less than $10^6$ Ωcm and not more than $10^{11}$ Ωcm, said toner being capable of carrying electric charges;

said developer preparing step including agitating said toner and said magnetic carrier and, before an effective development region of said developer is reached, mixing said toner and said magnetic carrier to electrify said toner to have a charge quantity greater than a predetermined level;

forming a magnetic brush by adsorbing the developer on a magnetic sleeve;

touching said magnetic brush to a photoreceptor and stroking said photoreceptor with said magnetic brush after said developer has reached the effective development region;

giving a localized movement and vibrational force to said magnetic carrier and said toner;

depositing said toner on a latent electrostatic image, which is formed on said photoreceptor, under the action of an electrical or magnetic disturbance, which promotes the supply and separation of the toner particles, prevents select development and toner scattering and decreases the carrier adhesion on said photoreceptor to form a toner image on said photoreceptor;

transferring said toner image onto the recording sheet by a transfer device which holds an electric field;

recharging the residual toner on said photoreceptor before cleaning after said toner image has been transferred; and removing said residual toner from said photoreceptor under the action of an electric field, wherein said toner has an average charge quantity that is 5–10 μc/g greater than a value at which a maximum amount of the toner is deposited for development, forming an image having a scan lines density of not less than 16 scan lines/mm and not more than 32 scan lines/mm.

2. A method as claimed in claim 1, wherein said residual toner removing step is achieved by using the same material as the developer which develops the latent electrostatic image, said material being circulated between a toner removing device and a development device.

3. A method according to claim 1, wherein said transferring step includes positioning conductive transfer bias rolls upstream and downstream of an image transfer zone, and applying a constant voltage to said conductive transfer bias rolls, said image transfer zone being an area where said photoreceptor having said latent electrostatic image contacts said transfer device.

4. A method according to claim 1, wherein said step of removing said residual toner includes pressing a cleaning web into contact with said transfer device.

5. A method according to claim 1, wherein said residual toner removing step includes supplying said residual toner with corona charges of the same polarity as that of the step of electrifying the toner.

6. A method according to claim 5, wherein said residual toner removing step further includes illuminating light on said photoreceptor either simultaneously with, or after supplying said residual toner with said corona charges, such that charges are selectively imparted to the toner to minimize effects of reverse charging caused by said toner image transferring step.

7. A method according to claim 1, further comprising cleaning said photoreceptor prior to subsequently forming an image on a subsequent recording sheet.

8. A method according to claim 1, further comprising permanently fixing said toner image after said toner image has been transferred onto said recording sheet, said permanently fixing step including heating said toner image having been transferred.

9. A method according to claim 8, wherein said heating step is performed by a heating roll, wherein said temperature of said heating roll is controllable at predetermined levels in accordance with a type of recording apparatus using said heating roll, and wherein a plurality of magnetic layers is positioned in said heating roll, according to a number of different Curie points for selecting among temperature levels desired, side-by-side on the surface of the heating roll in its axial direction, one of said magnetic layers being selected in accordance with the temperature to be controlled.

10. A method as recited in claim 1, wherein said carrier beads have aspirates, in the form of wrinkles, formed thereon.

* * * * *